US010704426B2

(12) United States Patent
Goethals et al.

(10) Patent No.: US 10,704,426 B2
(45) Date of Patent: Jul. 7, 2020

(54) METHOD FOR COOLING OFF THE COMPRESSED GAS OF A COMPRESSOR INSTALLATION AND COMPRESSOR INSTALLATION IN WHICH THIS METHOD IS APPLIED

(71) Applicant: ATLAS COPCO AIRPOWER, NAAMLOZE VENNOOTSCHAP, Wilrijk (BE)

(72) Inventors: Anton Jan Goethals, Wilrijk (BE); Jan Van Gilsen, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 142 days.

(21) Appl. No.: 15/504,894

(22) PCT Filed: Aug. 27, 2015

(86) PCT No.: PCT/BE2015/000038
§ 371 (c)(1),
(2) Date: Feb. 17, 2017

(87) PCT Pub. No.: WO2016/049712
PCT Pub. Date: Apr. 7, 2016

(65) Prior Publication Data

US 2017/0254223 A1 Sep. 7, 2017

(30) Foreign Application Priority Data

Aug. 29, 2014 (BE) ..... 2014/0654

(51) Int. Cl.
*F01K 9/00* (2006.01)
*F01K 25/08* (2006.01)
(Continued)

(52) U.S. Cl.
CPC ..... *F01K 9/003* (2013.01); *F01K 9/02* (2013.01); *F01K 25/08* (2013.01); *F25B 1/053* (2013.01);
(Continued)

(58) Field of Classification Search
CPC . F01K 9/003; F01K 9/02; F01K 25/08; F25B 1/053; F25B 5/04; F25B 2400/04;
(Continued)

(56) References Cited

U.S. PATENT DOCUMENTS 8,955,323 B2 * 2/2015 Kamiya ..... F04C 23/006 60/670
2006/0225423 A1 10/2006 Brostow
(Continued)

FOREIGN PATENT DOCUMENTS

CN 103032101 A 4/2013
CN 103154442 A 6/2013
(Continued)

OTHER PUBLICATIONS

Ohinese Office Action in related Chinese Application No. 201580048174.8, dated Jul. 3, 2018.
(Continued)

*Primary Examiner* — Joseph F Trpisovsky
(74) *Attorney, Agent, or Firm* — Bacon & Thomas, PLLC

(57) ABSTRACT

A compressor installation provided with one or more compressor elements and a heat recovery circuit in the form of a closed Rankine circuit in which a working medium circulates through one or more evaporators that act as a cooler for the compressed gas, and a condenser connected to a cooling circuit for cooling the working medium in the condenser, whereby an additional cooler is provided for each evaporator that is connected in series to an evaporator concerned, and which is calculated to be able to guarantee
(Continued)

sufficient cooling by itself when the heat recovery circuit is switched off.

5 Claims, 6 Drawing Sheets

(51) Int. Cl.
*F01K 9/02* (2006.01)
*F25B 1/053* (2006.01)
*F25B 5/04* (2006.01)

(52) U.S. Cl.
CPC ..... *F25B 5/04* (2013.01); *F25B 2400/04* (2013.01); *F25B 2400/073* (2013.01); *F25B 2500/09* (2013.01); *F25B 2600/2501* (2013.01)

(58) Field of Classification Search
CPC ..... F25B 2400/073; F25B 2500/09; F25B 2600/2501
USPC ..... 62/175
See application file for complete search history.

(56) References Cited

U.S. PATENT DOCUMENTS

2007/0289319 A1* 12/2007 Kim ..... F24F 5/0046 62/175
2011/0005477 A1 1/2011 Terashima et al.
2012/0285169 A1* 11/2012 Freund ..... F01N 5/02 60/643
2013/0084164 A1 4/2013 Adachi et al.
2013/0299123 A1* 11/2013 Matula ..... F03G 7/04 165/45

FOREIGN PATENT DOCUMENTS

CN 103573584 A 2/2014
DE 10 2012 220188 A1 5/2014
EP 0364106 A2 4/1990
EP 2578817 A2 4/2013
FR 2353715 A1 12/1977
FR 2476240 A1 8/1981
JP 2009236014 A 10/2009
JP 2013057256 A 3/2013
JP 2013092144 A 5/2013
JP 2014231739 A 12/2014
WO 2013046783 A1 4/2013

OTHER PUBLICATIONS

Japanese Office Action in related Japanese Application No. 2017-511703, dated Jul. 17, 2018.
International Search Report (ISR) dated Jan. 25, 2016, for PCT/BE2015/000038.

* cited by examiner

METHOD FOR COOLING OFF THE COMPRESSED GAS OF A COMPRESSOR INSTALLATION AND COMPRESSOR INSTALLATION IN WHICH THIS METHOD IS APPLIED

The present invention relates to a method for cooling the compressed gas of a compressor installation, more specifically of a compressor installation with heat recovery.

BACKGROUND OF THE INVENTION

It is known that the temperature of a gas increases due to compression and that the compressed gas must be cooled before it can be supplied to a consumer network in order to prevent damage to consumers.

To this end an 'aftercooler' is generally used that is connected to a cooling circuit with water that flows through the aftercooler, or use is made of the surrounding air that is blown through the aftercooler.

With multistage compressors with two or more compressor elements that are connected together in series, intercoolers are also used to cool the compressed gas coming from a previous compressor element before being drawn in by a subsequent downstream compressor element, as it is known that the efficiency of a compressor element is favourably influenced by lower temperatures of the gas to be compressed at the inlet of the compressor element concerned.

In this way a lot of heat energy is lost due to heating of the coolant that is transferred to the environment as hot water or hot air.

In order to recover a proportion of this lost heat energy and to convert it into usable energy, it is known to provide such a compressor installation with a heat recovery circuit in the form of a closed circuit that is known by the name of Organic Rankine Circuit and which is provided with a pump to enable a working medium to circulate in the circuit, successively through:

- one or more evaporators that act as a cooler for the compressed gas and in which the liquid working medium coming from the pump is converted into high pressure vapour due to heating by the heat of compression of the compressed gas;
- an expander in the form of a turbine or similar with a rotor, a piston or similar that is driven by the heated vapour and as such ensures the conversion into mechanical energy that can be used to drive a generator or similar; and
- one or more condensers that are connected to a cooling circuit of a coolant, for example water or air, to enable condensation of the vapour of the working medium into liquid that can be pumped around again by the pump for a subsequent cycle in which the working medium again undergoes a change of phase from liquid to vapour and back from vapour to liquid.

In this way the heat of compression of the compressed gas can be converted in a known way into another usable energy form on the shaft of the turbine or similar and at the same time the compressed gas can be cooled by making use of this heat recovery circuit.

A disadvantage of this method using a Rankine heat recovery circuit is that the compressed gas is not directly cooled by the coolant but is cooled by the intervention of the Rankine heat recovery circuit that is between the cooling circuit and the compressed gas to be cooled.

A disadvantage arising from this is that when the Rankine heat recovery circuit fails due to a breakdown or leakage of the working medium or similar, the evaporator cannot exert its cooling action on the compressed gas and that in this case the temperature at the inlet of the downstream compressor element and/or at the outlet of the compressor installation can become unacceptably high.

Such a method is shown, for example, in FIG. 7 of EP 2.578.817 for cooling the compressed gas originating from a multistage compressor with two compressor elements, whereby a Rankine circuit is used with two evaporators connected in parallel that are used as coolers for the compressed gas, respectively one evaporator that is used as an intercooler between the two compressor elements and one evaporator that is used as an aftercooler downstream from the second compressor element.

The aftercooler is followed by a conventional cooler that belongs to a separate cooling circuit through which a different coolant to the working medium of the Rankine circuit is guided, whereby according to the description in EP 2.578.817 this conventional cooler is intended to cool the compressed gas to a desired temperature that is based on the intended use of the compressor installation.

When the Rankine circuit fails in this compressor installation, the two evaporators lose their function as a cooler, such that the temperature of the compressed gas at the input of the second compressor element and at the output of the conventional cooler can become higher than desired for the intended use of the compressor installation, with all possible harmful consequences thereof.

A compressor device is known from EP 0.364.106 with a number of Rankine circuits to recover the heat from the compressed gas and to convert it into mechanical energy. The gas is compressed at night and stored in an underground tank to be able to be used together with an injected fuel to supply a gas turbine during the day. In this case the cooling effect of the Rankine circuits is secondary to the recovery of heat energy. Indeed, if in this case one or more Rankine circuits fail, this will have a detrimental effect on the heat recovery but will have a rather favourable effect on the power generated by the gas turbine as the turbine will then be supplied with compressed gas at a higher temperature, in contrast to the present invention where the cooling of the compressed gas is of paramount importance.

SUMMARY OF THE INVENTION

The purpose of the present invention is to provide a solution to one or more of the aforementioned and/or other disadvantages.

To this end the invention concerns a method for cooling a compressed gas of a compressor installation that is provided with one or more compressor elements, whereby for the cooling of the compressed gas the method comprises the step of making use of a heat recovery circuit in the form of a closed Rankine circuit with a working medium therein that is circulated during the operation of the Rankine circuit by means of a pump in the circuit; one or more evaporators that act as a cooler for cooling the compressed gas; an expander for converting thermal energy into mechanical energy; a condenser that is cooled by means of a cooling circuit with a coolant that is guided through it for cooling the working medium in the condenser, whereby the method consists of providing an additional cooler placed in series for cooling the compressed gas for at least one aforementioned evaporator that acts as a cooler for the compressed gas, whereby this additional cooler is cooled by means of a separate cooling circuit with a different coolant to the working medium of the Rankine circuit and whereby this additional cooler is calculated to be able to guarantee sufficient cooling of the compressed gas by itself, for a given cooling capacity of the cooling circuit concerned of the additional cooler, when the Rankine circuit is switched off.

The coolant in the cooling circuit is thus guided in series through the condenser and through the additional cooler.

When the heat recovery circuit fails there is no heating of the coolant that flows through the condenser and the cooling capacity of the coolant can be fully utilised for cooling the compressed gas that is guided through the additional cooler.

The compressor installation then operates as a conventional compressor without heat recovery. This means that the standard intercoolers and aftercoolers of a compressor without heat recovery can be used for the additional coolers and that such a conventional compressor can easily be converted into a compressor installation according to the invention that can be used with and without heat recovery.

Preferably the heat recovery circuit is an ORC circuit, i.e. an 'Organic Rankine Cycle' with an organic working medium that more specifically is characterised by a more favourable evaporation characteristic (temperature and pressure) for low temperature heat.

The lower the boiling temperature of the working medium, the better and more efficiently the ORC can be used for recovering heat from a compressed gas at a low temperature. Typically a working medium is selected whereby the temperature of the critical point is close to the maximum temperature of the heat source. The pressures, volume flows, greenhouse effect, toxicity and similar are also important.

The invention can be used in a single stage compressor with one single compressor element; an evaporator and an additional cooler for the aftercooling of the compressed gas coming from the single compressor.

The invention can also be used in a multistage compressor with two or more compressor elements connected in series and an evaporator and an additional cooler, for cooling the compressed gas coming from the compressor element placed immediately upstream, between each pair of compressor elements and downstream from the last compressor element, whereby the additional coolers are incorporated in the cooling circuit of the condenser in series with the condenser.

According to a practical embodiment of a multistage compressor according to the invention only one single ORC is used with one single condenser and a number of evaporators that act as an intercooler between two successive compressor elements or as an aftercooler downstream from the last compressor element.

The invention also relates to a compressor installation that is provided with one or more compressor elements and with cooling to cool the gas compressed by the compressor elements, whereby this cooling is formed by a heat recovery circuit that is realised as a closed 'Rankine circuit' with a pump, a working medium that circulates in the Rankine circuit during operation of the Rankine circuit by means of the pump; one or more evaporators through which the compressed gas to be cooled is guided for cooling the compressed gas; an expander for converting thermal energy into mechanical energy; and a condenser that is connected to a cooling circuit with a coolant that is guided through it to cool the working medium in the condenser, whereby the compressor installation comprises at least one additional cooler that is incorporated in series with an aforementioned evaporator in the gas flow of the compressed gas to be cooled and whereby this at least one additional cooler is connected to a cooling circuit with a different coolant to the working medium of the Rankine circuit, and this additional cooler is calculated to be able to guarantee sufficient cooling of the compressed gas by itself, for a given cooling capacity of the cooling circuit, when the Rankine circuit is switched off.

BRIEF DESCRIPTION OF THE DRAWINGS

With the intention of better showing the characteristics of the invention, a few preferred embodiments of a compressor installation according to the invention for compressing a gas with heat recovery are described hereinafter by way of an example, without any limiting nature, with reference to the accompanying drawings, wherein.

DETAILED DESCRIPTION OF THE INVENTION

Figure 1:
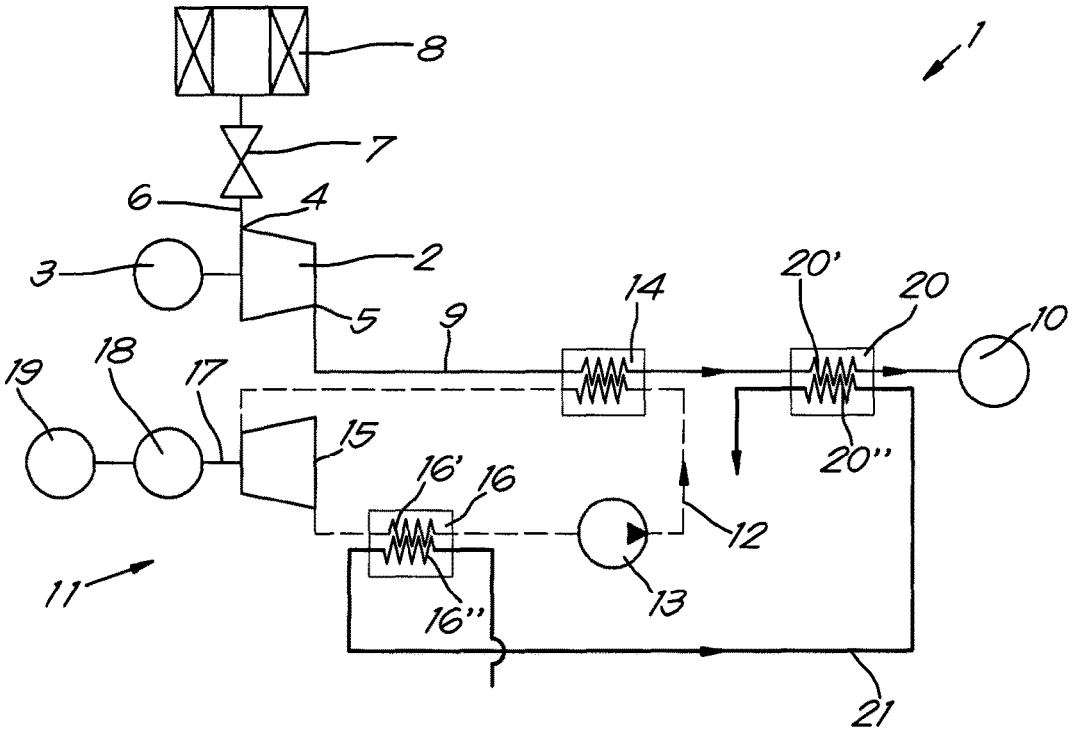
FIG. 1 schematically shows a compressor installation according to the invention.

In this case the compressor installation 1 shown in FIG. 1 comprises one single stage compressor with one compressor element 2 with a drive 3 in the form of a motor or similar.

The compressor element 2 is provided with an inlet 4 and an outlet 5, whereby in this case the inlet 4 connects to a suction pipe 6 with an inlet valve 7 therein and a suction filter 8, while the outlet 5 connects to a pressure pipe 9 for compressed gas to which a consumer network 10 can be connected.

The compressor installation 1 is further provided with a heat recovery circuit 11 in the form of a closed circuit 12 in which a working medium circulates according to an 'Organic Rankine Cycle', abbreviated to ORC, by means of a pump 13 that successively drives the working medium through an evaporator 14; an expander 15; a condenser 16 and thus back to the pump 13.

The aforementioned expander 15 is configured such that it enables the thermal energy to be converted into mechanical energy, for example because it is constructed in the form of a turbine, with an outgoing shaft 17 that is coupled to a load, such as a generator 18 for supplying electrical energy to a consumer 19.

The evaporator 14 is incorporated as a cooler in the aforementioned pressure pipe 9 in series with an additional cooler 20 for cooling the compressed gas coming from the compressor element 2. More specifically a primary section of the evaporator 14 is connected in series to a primary section 20' of the additional cooler 20.

Together with the aforementioned additional cooler 20, the condenser 16 is incorporated in series in a separate cooling circuit 21 through which a different coolant to the working medium of the Rankine circuit 12, for example water or a different coolant, is guided, for example by means of a pump or similar that is not shown. More specifically a secondary section 16" of the condenser 16 is connected in series to a secondary section 20" of the additional cooler 20.

The heat recovery circuit 11 and the cooling circuit 21 are preferably configured such that the direction of flow of the working medium in the evaporator 14 (in this case a secondary section of the evaporator 14) and of the coolant in the additional cooler 20 (more specifically in the secondary section 20" of the additional cooler 20) are opposite to the direction of flow of the compressed gas that flows through it (in this case through the primary section of the evaporator 14 and the primary section 20' of the additional cooler (20), which ensures an efficient heat transfer from the one medium to the other medium.

Analogously the working medium and the cooling medium are guided through the condenser 16 in opposite directions. Indeed, in the example shown the working medium is guided in a first direction through the primary section 16' of the condenser 16, while the coolant is guided in a second direction through the secondary section 16" of the condenser 16, opposite to the aforementioned first direction of the working medium.

The operation of the compressor installation 1 according to the invention is very simple and as follows.

When the compressor element 2 is driven, a gas, for example air, is drawn in via the inlet 4 and supplied to the consumer network 10 under pressure via the pressure pipe 9.

The compressed gas leaves the compressor element 2 at a high outlet temperature, which means that the compressed gas must be cooled before it is supplied to a consumer network 10 in order to prevent damage to the consumers in this consumer network 10.

The compressed gas is partly cooled in the additional cooler 20 and partly in the evaporator 14 that are incorporated in series in the pressure pipe 9, at least insofar the pump 13 of the heat recovery circuit 11 makes the working medium circulate in the circuit 12. The additional cooler 20 is preferably incorporated in the pressure pipe 9 downstream from the evaporator 14.

The pump 13 drives the working medium in liquid form through the evaporator 14 where the working medium is heated by the compressed gas that flows through the evaporator 14.

The working medium is selected such that at a certain pressure the boiling temperature of the working medium is lower than the outlet temperature of the compressed gas so that the working medium can evaporate in the evaporator 14 and it leaves the evaporator 14 as a vapour at an increased pressure realised by the pump 13, whereby the vapour can undergo an expansion in the expander 15, such that the expander is driven and thereby also the generator 18 or another useful load.

An example of a suitable organic working medium is 1,1,1,3,3-pentafluoropropane.

Then the expanded working medium flows in vapour form through the condenser 16 where it comes into contact with the low temperature of the coolant, which ensures that the working medium condenses to be able to be pumped around as a liquid by the pump 13 for a subsequent cycle.

The additional cooler 20 is calculated, on the basis of the available cooling capacity of the cooling circuit 21, to be able to sufficiently cool the compressed gas without the cooling action of the evaporator 14, for example when the heat recovery circuit 11 has failed due to a defect or similar, whereby the coolant is then guided through the additional cooler 20 without a temperature increase in the condenser 16.

This means that the additional cooler 20 is dimensioned for a conventional operation without heat recovery and that the cooling capacity of the additional cooler 20 is then overdimensioned for operation with heat recovery, but with the great advantage that the compressor installation 1 can continue operating when the heat recovery circuit 11 fails.

The best result in recovering the heat energy to a maximum is achieved when the additional cooler 20 is placed in the pressure pipe 9 downstream from the evaporator 14, and the condenser 16 is provided in the cooling circuit 21 upstream from the additional cooler 20, although other configurations are not excluded.

In the example shown the condenser 16 and the additional cooler 20 are incorporated in series in a common cooling circuit 21, although this is not strictly necessary and two separate cooling circuits may also be provided.

Figure 2:
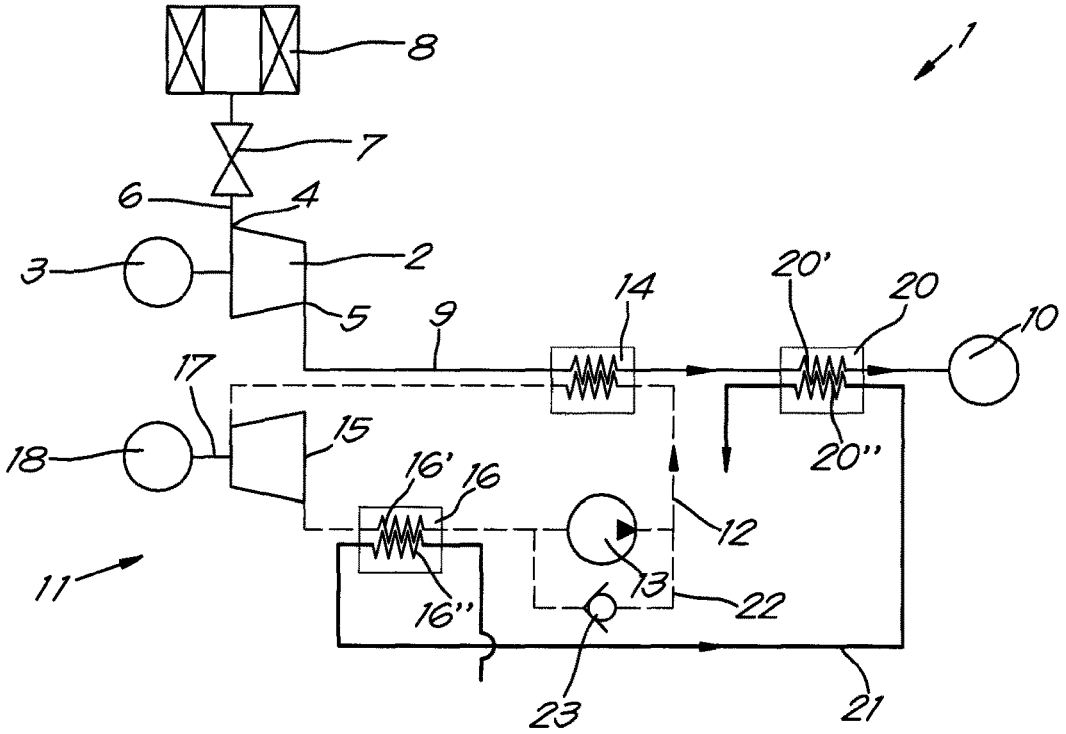
FIGS. 2 to 4 each show a different variant of the compressor installation of FIG. 1.

The compressor installation 1 of FIG. 2 differs from that of FIG. 1 by the ORC circuit 12 being provided with a bypass 22 that connects the input and output of the pump 13 together, and in which a non-return valve 23 is incorporated that enables a flow of the working medium from the input to the output of the pump 13 but prevents a flow in the reverse direction.

This bypass 22 is used in event of a stoppage of the pump 13 to enable a natural circulation of the working medium in cases when the pump 13 does not present any leaks between the input and output when stopped.

Figure 3:
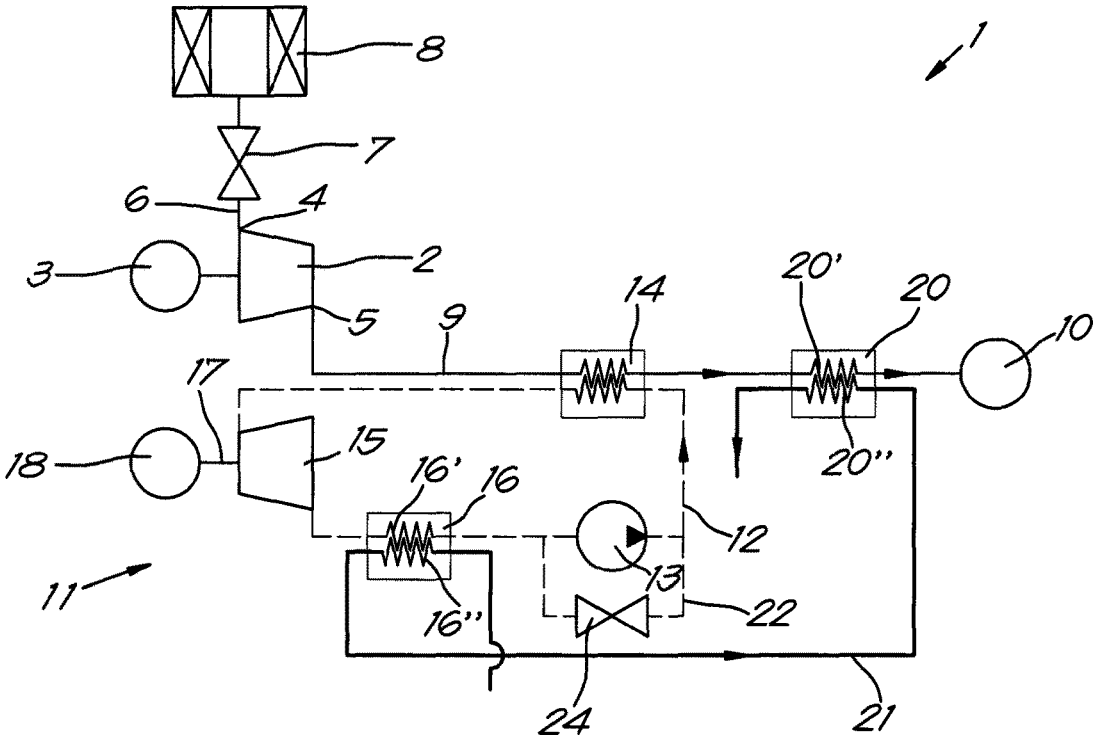

FIG. 3 shows the same compressor installation as that of FIG. 2, with the difference that the non-return valve 23 is replaced by a bypass valve 24 that is controllable or otherwise for the control of the Rankine cycle. If the bypass valve 24 is made controllable, to this end it is connected to a control unit or 'controller' that is not shown in the drawings, either by means of an electrical connection, or by means of another form of connection that enables a control signal to be sent from the control unit to the bypass valve 24.

Figure 4:
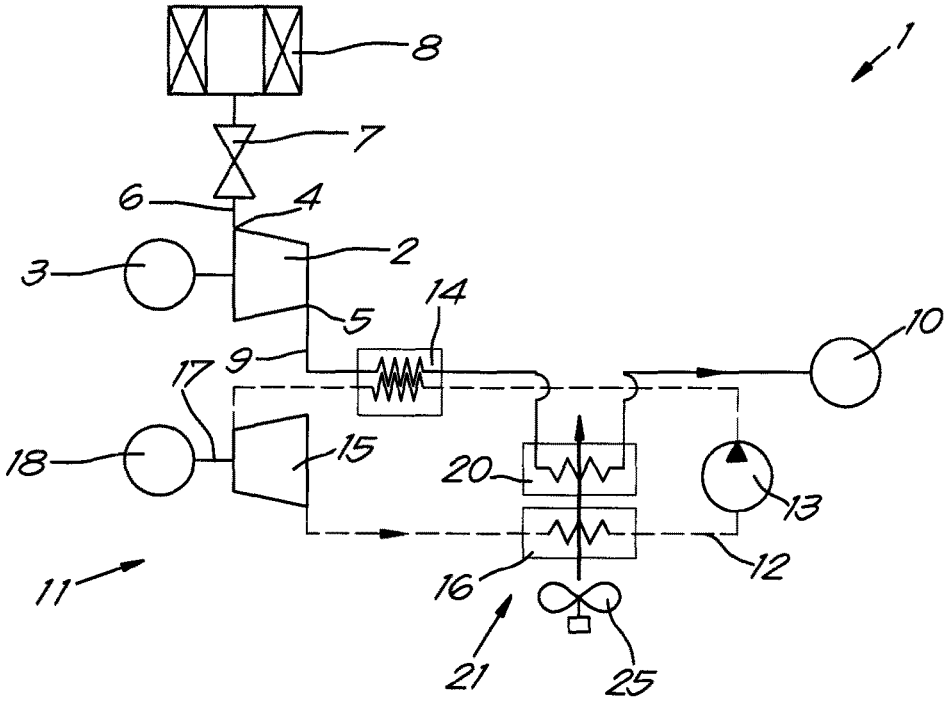

FIG. 4 shows a variant of a compressor installation 1 according to the invention whereby in this case, with respect to the embodiment of FIG. 1, the cooling circuit 21 with a liquid coolant is replaced by a cooling circuit 21 with cooling by means of the surrounding air or another cooling gas that is blown successively over the condenser 16 and over the additional cooler 20 by means of a fan or similar, whereby to this end the condenser 16 and the additional cooler 20 are constructed as a radiator instead of a heat exchanger with a primary section through which the working medium, and the compressed gas respectively, is guided and a secondary section through which the coolant is guided.

Figure 5:
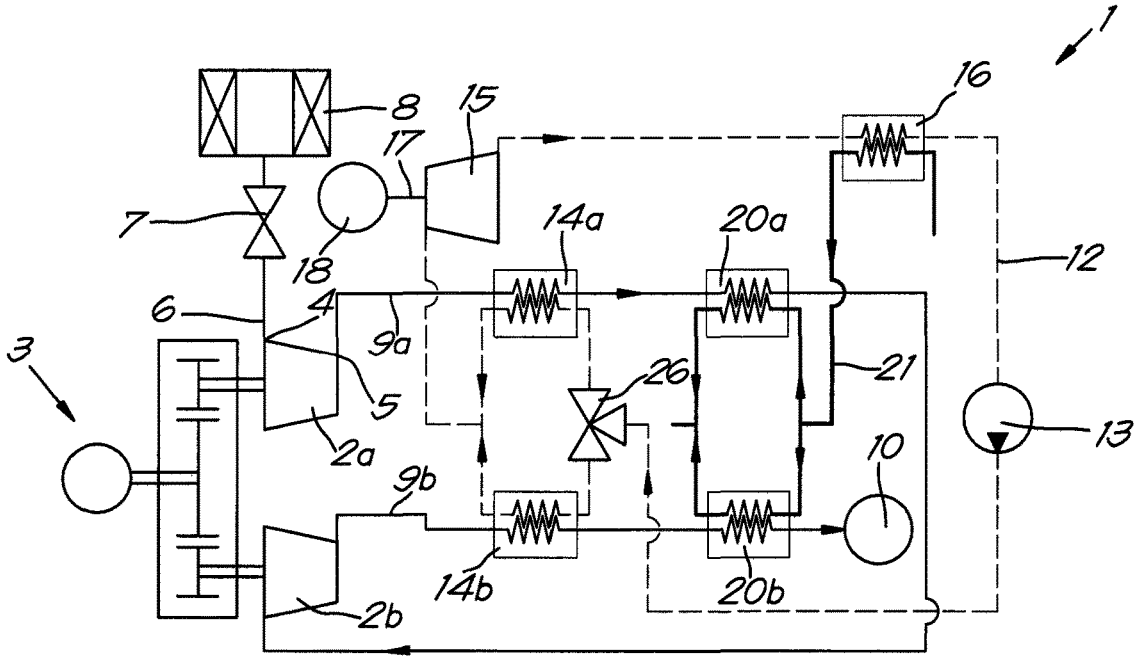
FIGS. 5 to 11 show possible variants of a compressor installation according to the invention.

FIG. 5 shows a compressor installation 1 according to the invention that comprises a multistage compressor 1, in this case with two compressor elements 2 connected in series, respectively for a compressor element 2*a* of the low pressure stage and a compressor element 2*b* of the high pressure stage, which in this case are driven together by a common drive 3 and which are connected together by an intermediate pressure pipe 9*a*.

In this case the ORC circuit 12 comprises two evaporators 14 to be able to extract heat, on the one hand from the compressed gas coming from the compressor element 2*a* and on the other hand from the compressed gas coming from the compressor element 2*b*, to which one evaporator 14*a* is incorporated in the intermediate pressure pipe 9*a* and the other evaporator 14*b* is incorporated in the pressure pipe 9*b* to the consumer network 10.

Upstream from each evaporator 14*a* and 14*b*, an additional cooler 20 is provided, respectively cooler 20*a* and cooler 20*b*, that is incorporated in the pressure pipes 9*a* and 9*b* in series with an evaporator 14*a*, respectively 14*b*, concerned for cooling the gas that is guided through this additional cooler 20*a* and 20*b*.

The evaporators 14*a* and 14*b* are incorporated in the cooling circuit 21 in parallel whereby a threeway valve 26 is provided in the circuit at the parallel input of the evaporators 14*a* and 14*b* in order to distribute the flow of the working medium coming from the pump 13 over both evaporators 14*a* and 14*b*, and this depending on the temperatures of the compressed gas at the outlet 5 of the compressor elements 2*a* and 2*b* that depend on the pressure ratios of the compressor elements 2*a* and 2*b* and/or depend on the temperatures of the working medium at the outlet of the evaporators 14*a* and 14*b*.

In this case, the additional coolers 20*a* and 20*b* are connected together in parallel and incorporated in the cooling circuit 21 in series together with the condenser 16 and are so dimensioned that they can ensure sufficient cooling of the compressed gas when the ORC circuit 12 fails.

It is clear that in this case only one single evaporator 14 can be used in one of the pressure pipes 9*a* or 9*b*, whereby an additional cooler 20 is provided in this pressure pipe 9*a* or 9*b* with the evaporator 14, while in the other pressure pipe without an evaporator 14 only a conventional intercooler or aftercooler 20 is provided, whereby the additional cooler 20 is then incorporated in the cooling circuit 21 in series with the condenser 16 while the conventional cooler 20 can also be connected in series in this cooling circuit 21 or in a separate circuit.

Figure 6:
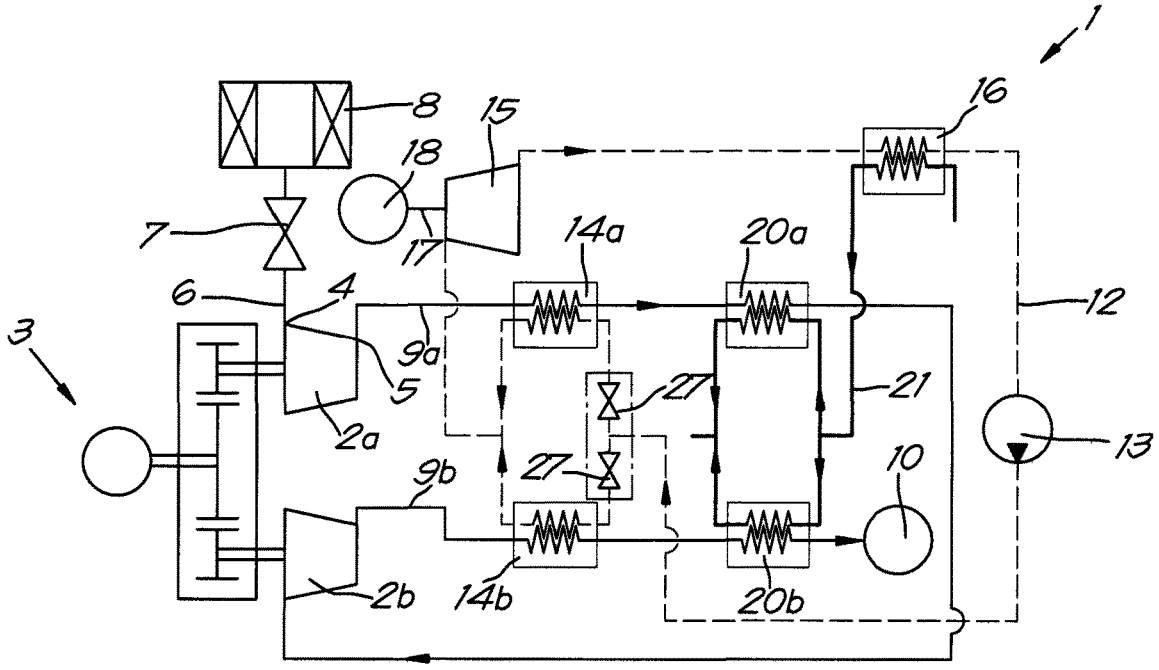
Figure 7:
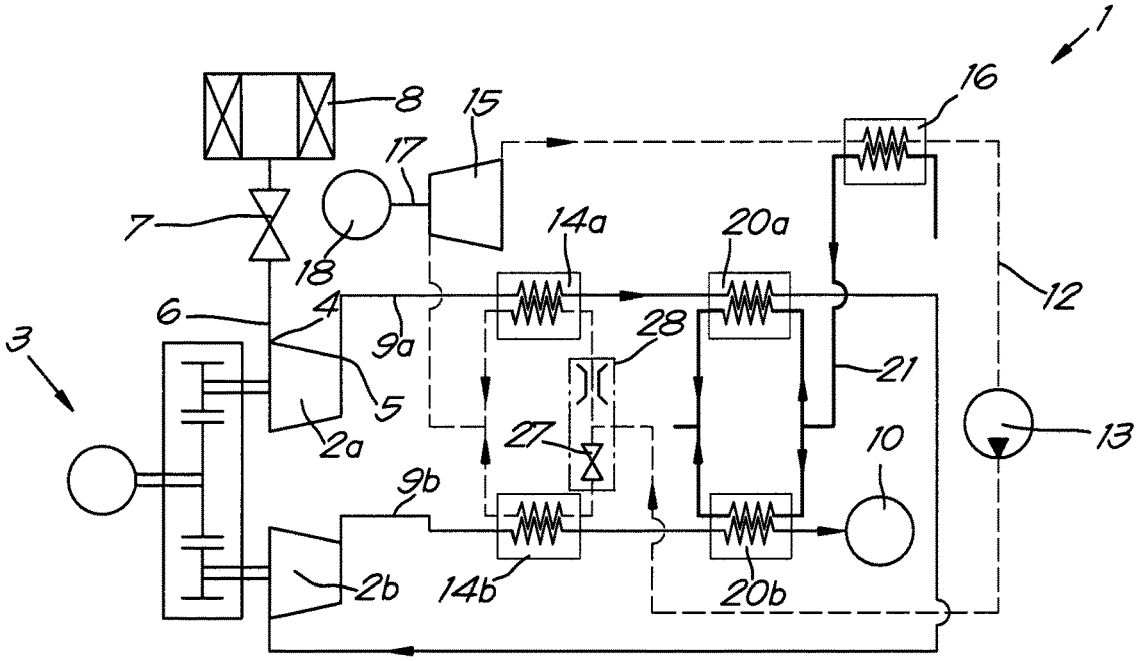

FIG. 6 shows a variant whereby the threeway valve is replaced by two separate valves 27 with the same function, while in FIG. 7 instead of a threeway valve, a valve 27 and a restrictor 28 are applied.

Figure 8:
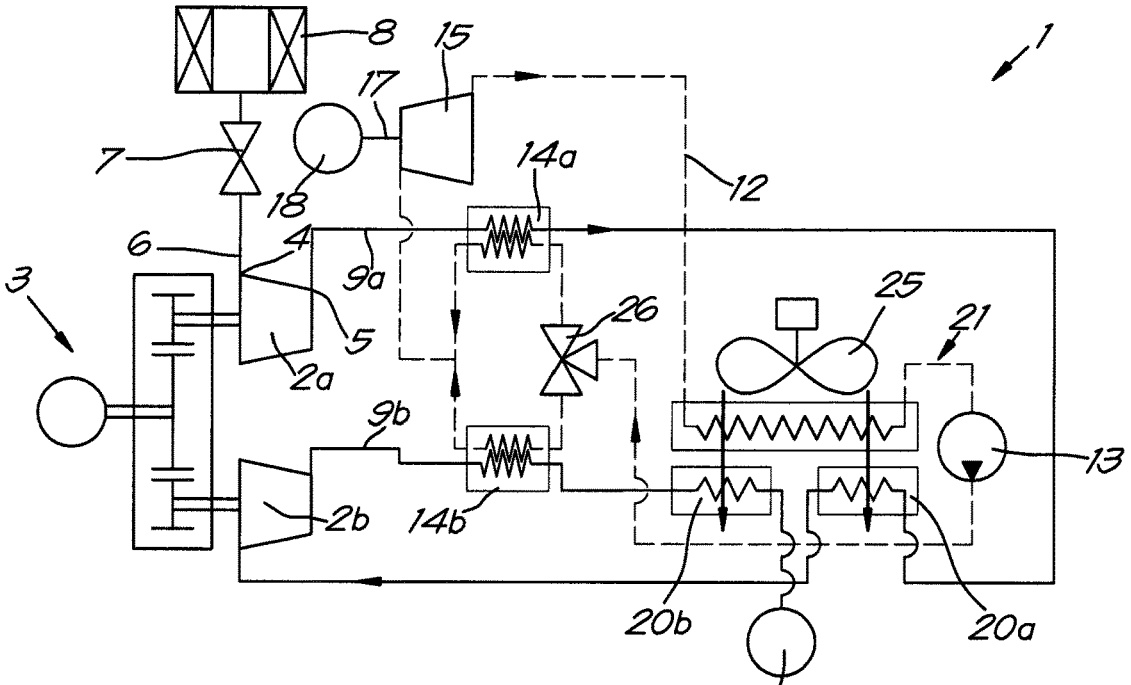

FIG. 8 shows a compressor such as that of FIG. 5, but whereby in this case the cooling circuit 21 is based on air cooling.

Figure 9:
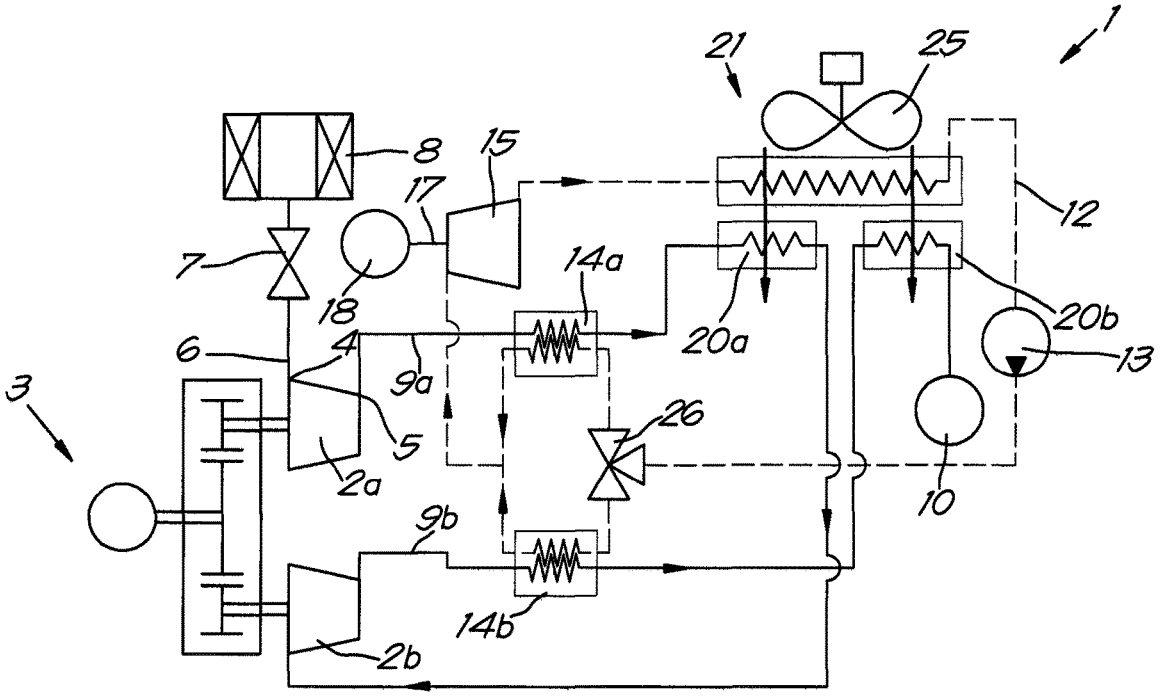

FIG. 9 shows an identical configuration to that of FIG. 8, but whereby the coolers 20*a* and 20*b* have changed places.

Figure 10:
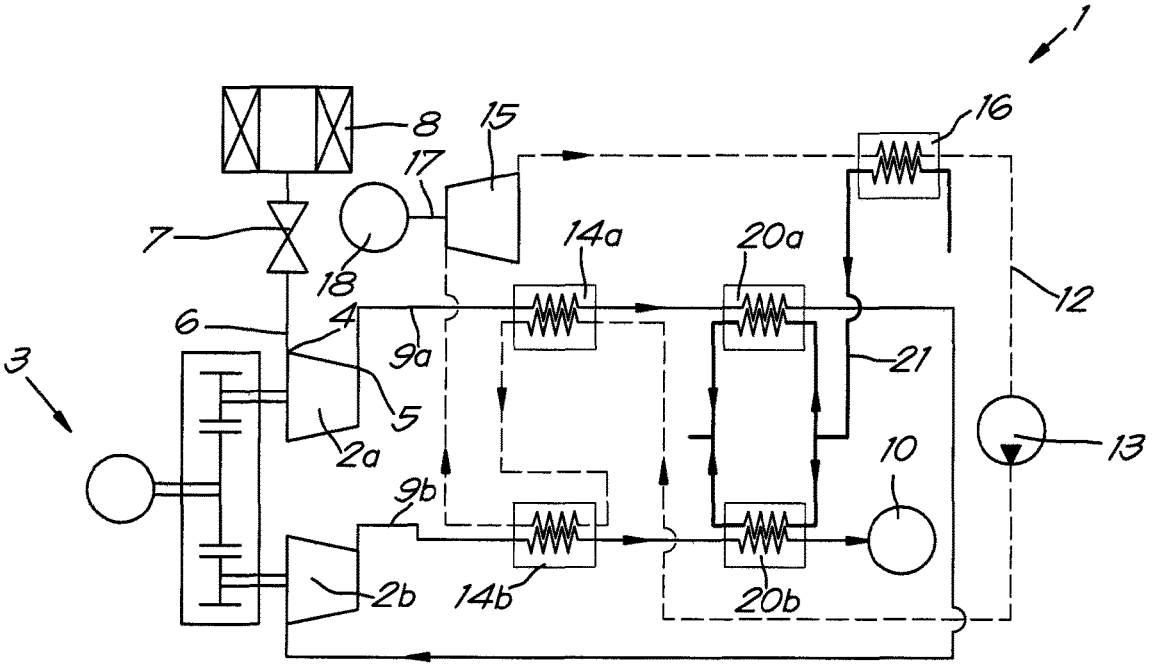
Figure 11:
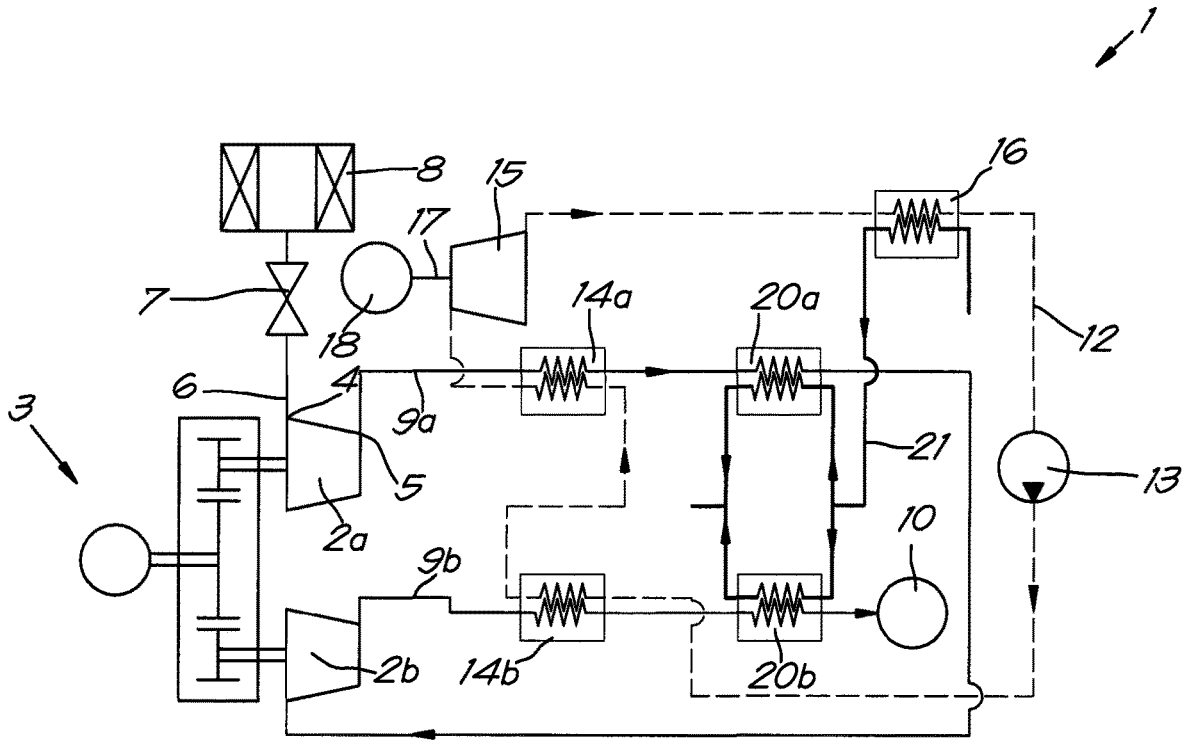

Each of the FIGS. 10 and 11 show a variant of FIG. 5 whereby in this case the evaporators 20*a* and 20*b* are connected in series in the heat recovery circuit 11 instead of in parallel, such that in this case no means are required either such as a threeway valve 26 or similar, in order to distribute the flow of the working medium that circulates in the heat recovery circuit 11 over the evaporators 14*a* and 14*b*.

In FIG. 10 the working medium first passes through the evaporator 14*a* of the low pressure compressor element 2*a* and then through the evaporator 14*b* of the high pressure compressor element 2*b*, while this is precisely the reverse in FIG. 11.

It is clear that if, in a multistage compressor such as in the case of FIGS. 5 to 11, there are no limitations with regard to maximum temperature of the compressed gas supplied to the consumer network 10, an additional aftercooler 20*b* may be omitted as, when the cooler function of the aftercooler 14*b* fails due to the failure of the heat recovery circuit 11, the temperature increase at the output of the additional aftercooler 20*b* is not limited.

In summary the invention concerns a compressor installation for compressing a gas with heat recovery, whereby this compressor installation is provided with one or more compressor elements 2 and a heat recovery circuit 11 for the recovery of the heat of compression from the compressed gas, whereby this heat recovery circuit 11 is realised as a closed circuit with a pump 13 to enable a working medium to circulate in it according to a 'Rankine cycle' through one or more evaporators 14 that act as a cooler for the compressed gas coming from an upstream compressor element 2 that is guided through it and in which the working medium is heated by the compressed gas; an expander 15 for converting thermal energy into mechanical energy; and a condenser 16 that is connected to a cooling circuit 21 with a coolant for cooling the working medium in the condenser 16, characterised in that the compressor installation 1 comprises an additional cooler 20 for each evaporator 14 that acts as an intercooler between two successive compressor elements 2 and/or for an evaporator 14 that acts as an aftercooler that is connected in series to an evaporator 14 concerned for cooling the gas that is guided through this evaporator 20, and that each additional cooler 20 is incorporated in the aforementioned cooling circuit 21 of the condenser 16, whereby the one or more additional coolers 20 are calculated to be able to guarantee sufficient cooling by themselves, for a given cooling capacity of the cooling circuit 21, when the heat recovery circuit 11 is switched off.

The present invention is by no means limited to the embodiments described as an example and shown in the drawings, but a compressor according to the invention for compressing a gas with heat recovery can be realised in all kinds of forms and dimensions without departing from the scope of the invention, and by extension is also applicable to compressors with more than two compression stages.

The invention claimed is:

1. A compressor installation comprising one or more compressor elements configured to provide a cooling to cool the gas compressed by the one or more compressor elements, whereby said cooling comprises:

a heat recovery circuit that is realized as a closed 'Rankine circuit' with a pump, and a working medium that circulates in the Rankine circuit during operation of the Rankine circuit by means of the pump;

one or more evaporators through which the compressed gas to be cooled is guided for cooling the compressed gas;

an expander configured in a way to convert thermal energy into mechanical energy; and a condenser that is connected to a cooling circuit with a coolant that is guided through said cooling circuit to cool the working medium in the condenser, wherein the compressor installation comprises at least one additional cooler that is incorporated in series with at least one of the one or more evaporators in a gas flow direction of the compressed gas to be cooled, and wherein the one or more evaporators are in the gas flow direction of the compressed gas to be cooled upstream from the at least one additional cooler, wherein said at least one additional cooler is connected to the cooling circuit with the condenser, wherein said cooling circuit is configured so that said condenser is connected in series upstream from the at least one additional cooler so that said coolant is guided through the additional cooler without a temperature increase in the condenser and said at least one additional cooler has a cooling capacity to cool of the compressed gas, for a given cooling capacity of the cooling circuit, when the Rankine circuit is switched off.

2. The compressor installation according to claim 1, wherein the Rankine circuit is an Organic Rankine Circuit (ORC circuit), in which an organic working medium circulates.

3. The compressor installation according to claim 2, wherein the boiling temperature of the organic working medium is below 90° C.

4. The compressor installation according to claim 1, wherein the compressor installation comprises a single stage compressor with one single compressor element; wherein said at least one or more evaporators of said Rankine circuit acts as an aftercooler; and an additional aftercooler for cooling the compressed gas coming from the one compressor element.

5. The compressor installation according to claim 3, wherein the boiling temperature is below 60° C.

* * * * *